United States Patent [19]

Faris

[11] Patent Number: 4,986,457

[45] Date of Patent: Jan. 22, 1991

[54] CLOSED LOOP CABLE SYSTEM

[75] Inventor: F. Dale Faris, San Diego County, Calif.

[73] Assignee: Lucky Line Products, San Diego, Calif.

[21] Appl. No.: 476,823

[22] Filed: Feb. 8, 1990

[51] Int. Cl.[5] ..... E05B 69/00; E05B 69/02

[52] U.S. Cl. ..... 223/1; 223/88; 70/59; 70/58; 70/57.1; 24/703.1; 24/265 A; 24/115 A; 24/182; 403/165; 403/274; 403/284; 403/110

[58] Field of Search ..... 223/1, 85, 88, 92, 91, 223/93, 95; 70/57, 57.1, 58, 59, 49; 24/703.10, 265 A, 115 A, 182; 403/165, 274, 284, 109, 110, 292, 373, 361, 283, 377, 375

[56] References Cited

U.S. PATENT DOCUMENTS

| | | | |
|---|---|---|---|
| 1,040,181 | 10/1912 | Frank | 223/92 |
| 1,043,351 | 11/1912 | Paskell | 223/92 |
| 1,713,621 | 5/1929 | Price | 223/92 |
| 2,013,217 | 10/1935 | Olmstead | 403/284 |
| 2,276,571 | 3/1942 | Gryma | 403/284 |
| 2,327,650 | 8/1943 | Klein | 24/115 A |
| 3,886,770 | 6/1975 | Smith | 70/58 |
| 4,069,691 | 1/1978 | Simpson | 70/59 |
| 4,073,415 | 2/1978 | Pegg | 70/59 |
| 4,540,092 | 10/1985 | DeSantis | 70/59 |
| 4,685,572 | 8/1987 | Jamison | 70/59 |
| 4,823,569 | 4/1989 | Leinoff | 70/57 |

FOREIGN PATENT DOCUMENTS

| | | | |
|---|---|---|---|
| 2156420 | 10/1985 | United Kingdom | 70/58 |

*Primary Examiner*—Werner H. Schroeder
*Assistant Examiner*—Bibhu Mohanty
*Attorney, Agent, or Firm*—Ralph S. Branscomb

[57] ABSTRACT

The closed loop cable system was designed for preventing the theft of coats, but could be used for many other applications. When used for theft prevention, a length of cable is passed through one or both sleeves of the coat to form a loop, and the cable ends, which are provided with mating ferrules are then mated together and then crimped. The cable loop through bath sleeves prevents anyone from trying the coat on, and through one sleeve enables customers to try the coat on, but alerts clerks that it has not been paid for, and thus prevents anyone from putting a coat on and walking out without paying for it. A specialized tool is used to crimp ferrules on the ends of the cable together, and the same tool can be used to cut the cable.

8 Claims, 1 Drawing Sheet

CLOSED LOOP CABLE SYSTEM

BACKGROUND OF THE INVENTION

The invention is in the field of cables that close into an inseparable loop, one example of the use of which is in garment theft prevention. Recent years have seen a considerable increase in the use and visibility of theft prevention systems in department and clothing stores. Some stores have plastic badges secured to the cloth which trigger an alarm at sensors adjacent the store exits if the badge has not been removed. Removal of the badge requires a special tool. Because clothing can be quite expensive, and the nature of clothing displays encourage shoplifters, theft-prevention systems which were all but non-existent twenty years ago, will probably become increasingly the rule rather than the exception.

Although the magnetic disc system seems to work well in stores that have a considerable quantity of clothing, in operations that just have a short line, the system might be somewhat cumbersome and too expedient and complicated. There is a need for an extremely simple, low-tech system that can be used, particularly for leather jackets and sport coats in stores such as warehouse stores which do not carry extensive racks of clothing, but do have lines of expensive coats such as leather jackets.

SUMMARY OF THE INVENTION

The theft prevention system using the cable loop of this disclosure is an extremely simple one which can be explained to employees in several seconds, and can be put in practice so simply that there is virtually no learning curve. The system is ideal for establishments with high employee turnover, as little time is required to explain it to new hires. The system comprises a plastic-coated cable having a ferrule on each end. The cable was designed primarily for coats, and when used on coats, the cable is passed through one or both sleeves, the ferrules mated, and then crimped together to define a continuous loop.

The loop prevents customers from putting the coats on. The theft problem with coats involves people putting on the coats and leaving the store as though they had come in with the coat. In warehouse stores there is no dressing room, so customers cannot put on shirts, underwear, etc. Coats are vulnerable, though, since not only can they be put on without dressing rooms, they are also often expensive. With the cable in place through only one sleeve, when a customer wants to try on a coat. He can do so, but the cable loop must be cut by the cashier when the coat is purchased, or it would be obvious that the coat had been stolen. A specialized tool is provided which enables the crimp of the ferrules to be done very quickly, and the tool also has cutting jaws to cut the cable.

BRIEF DESCRIPTION OF THE DRAWINGS

FIG. 4 illustrates the connected ferrules of FIG. 3 after the crimp has been put in;

DETAILED DESCRIPTION OF THE PREFERRED EMBODIMENT

Figure 1:
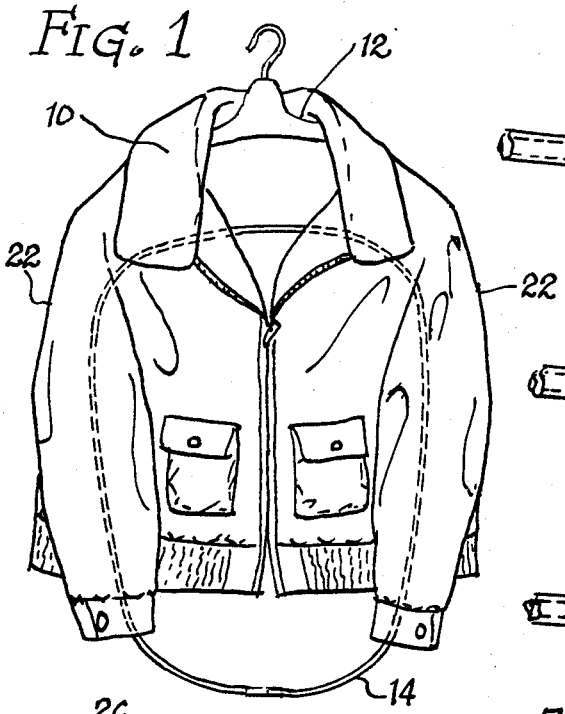
FIG. 1 illustrates a coat on a hanger with the cable passed through the sleeves in two alternative modes of use, and crimped.
Figure 2:
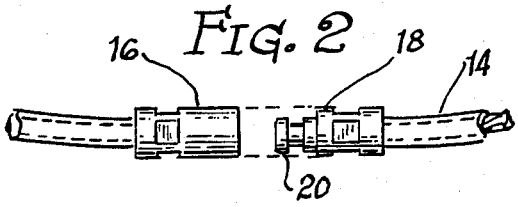
FIG. 2 illustrates the male and female ferrules used in the invention.

As mentioned above, the invention is primarily to prevent theft of coats but could also be used for other clothing garments as long as such garments have an opening such as a neck opening, a sleeve, a pant leg, or even button holes. It could be used in a much shorter version for a non-openable key ring, or in any application where a permanently closed cable loop is needed. As shown in FIG. 1, a typical coat 10 is displayed on a hanger 12. The cable is shown in both the two-sleeve mode, and the single-sleeve mode.

Figure 3:
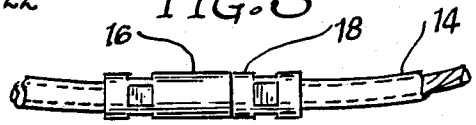
FIG. 3 illustrates the ferrules of FIG. 1 after they have been connected.
Figure 4:
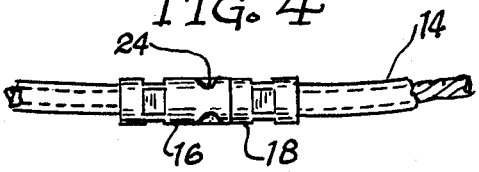
Figure 5:
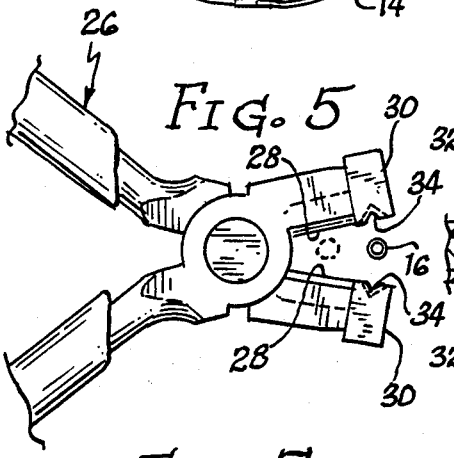
FIG. 5 illustrates the operative portion of the special plier-like tool used to crimp the ferrules and cut the cable.
Figure 6:
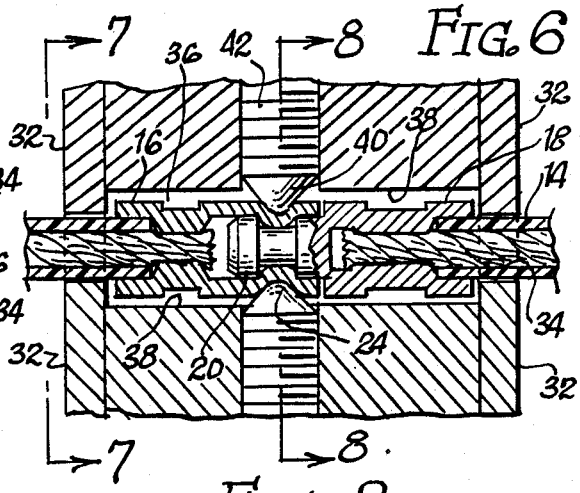
FIG. 6 is an enlarged section taken through the head of the tool and a cable gripped therein.

The cable 14 that is used is preferably a relatively fine gauge plastic-coated cable. At one end of the cable a female ferrule 16 is mounted, and at the other end a male ferrule 18 is attached. The male ferrule has a boss 20 at its tip so that when the ferrules are slipped together as shown in FIG. 3 after the cable has been passed through the sleeves 22 of the coat, then a crimp is put into opposite sides of the female ferrule 16 as indicated at 24 in FIG. 4. The action is shown even better in FIG. 6. It can be seen that a good connection between the ferrules is provided by the crimping.

Figure 7:
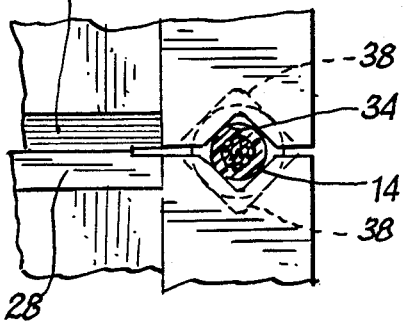
FIG. 7 is a side elevation view taken along lines 7—7 of FIG. 6 with the cable being section.
Figure 8:
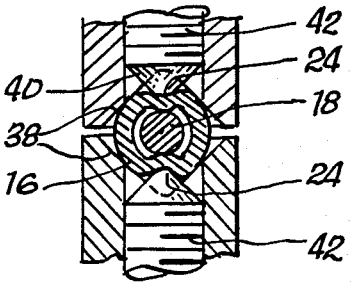
FIG. 8 is a section taken along line 8—8 of FIG. 6.

In order for the crimping to be done quickly and easily, a special tool 26 is provided which has conventional wire or cable cutters 28 and two opposed crimping jaws 30. The cutter portion 28 acts like any wire cutters, and cuts by bringing the opposed blades together. The crimping jaws serve both to seat the joined ferrules in the configuration of FIG. 3 properly in the tool so that the crimping is properly centered, and they also effect the crimping itself. As can best be seen by reference to FIG. 6, the crimping jaws 30 have sidewalls 32 which are notched at 34 to pass the cable through the opposed notches when the crimping jaws are closed. However, the notches are too small to pass the ferrule therethrough when the jaws are closed, so that the seat is defined between the sidewalls at 36 in each of the jaws. It can be seen by reference to FIG. 6 that it is virtually impossible to misalign the ferrules in the seat 36. As can be seen from FIG. 7, the body portion of the jaws have semi-cylindrical recesses 38 to accommodate the cable and the ferrules.

Once the ferrules have been properly seated, in the same jaw-closing motion, the pointed tips 40 of the set screws 42 crush into the ferrule 16 to define the crimps 24. It can be seen that the dimensions of the ferrules are such that the crimp is centered between the ends of the respective ferrules, so that it makes no difference which ferrule is on the left or right within the jaws of the crimping tool.

Utilizing set screws for the crimping permits them to be periodically adjusted to compensate for wear and accidental dislocations of the set screws from their appropriate setting.

The system is so simple and inexpensive that it is ideal for stores without dressing rooms that carry an incidental line of other garments. The start-up cost is negligible, and the employee training time is minimal.

I claim:

1. A garment theft prevention system comprising:

(a) a length of cable of sufficient length to pass longitudinally through at least one sleeve of a coat such that the ends meet;

(b) two ferrules mounted respectively on each end of said length of cable; and, (c) said ferrules being respectively male and female and matable together to be crimped together such that an inseparable closed loop is formed by said length of cable.

2. A closed cable loop system comprising:

(a) a length of cable;

(b) two ferrules mounted respectively on each end of said length of cable;

(c) said ferrules being configured to be mated together and crimped together such that a inseparable loop in formed by said length of cable; and, (d) one of said ferrules being male and the other of said ferrules being female, and said male ferrule terminating in an enlarged boss to make a positive connection with said female ferrule when crimped.

3. A system according to claim 2 and including a specialized crimping tool having a pair of positioning and crimping jaws which define a seat for said ferrules when mated and each jaw has a crimping projection such that said ferrules can be seated in said seat and said jaws closed, creating a crimp at an optimal location on said ferrules.

4. A system according to claim 3 wherein said crimping projections of said pliers are defined by a pair of set screws set in substantially diametrically opposed orientation in said respective jaws.

5. A system according to claim 4 wherein said jaws also define cable-cutting blades such that said cable can be cut and removed from a garment after the ferrules have been crimped.

6. A method of preventing the theft of coats by using a length of cable terminated at both ends by mating ferrules, said ferrules being crimped together to form an inseparable loop with said cable, said method comprising the following steps:

(a) looping said cable longitudinally through at least one of the sleeves of said coat;

(b) mating said ferrules together; and, (c) crimping said ferrules together.

7. A method according to claim 6 and including the step of cutting said cables with wire cutters and removing the cable from the coat when said coat is purchased.

8. A method according to claim 6 wherein step (a) comprises looping said cable through both sleeves.

* * * * *